US005308941A

United States Patent [19]

Hoh et al.

[11] Patent Number: 5,308,941

[45] Date of Patent: May 3, 1994

[54] ROLLER CONTACT ASSEMBLY

[75] Inventors: Quah T. Hoh, Bayan Lepas; Tan S. Hai, Taman Sri Nibong, both of Malaysia

[73] Assignee: Motorola, Inc., Schaumburg, Ill.

[21] Appl. No.: 45,348

[22] Filed: Apr. 12, 1993

[51] Int. Cl.[5] ..... H01H 1/16

[52] U.S. Cl. ..... 200/277; 200/290

[58] Field of Search ..... 200/277, 277.1, 277.2, 200/550, 530, 531, 562, 563, 241, 242, 290

[56] References Cited

U.S. PATENT DOCUMENTS

| | | | |
|---|---|---|---|
| 1,255,795 | 2/1918 | Savage | 200/277 |
| 1,651,314 | 11/1927 | Beasley, Jr. | 200/277 |
| 2,166,345 | 7/1939 | Douglas | 200/290 |
| 3,249,730 | 5/1966 | Felson | 200/277 |
| 3,278,715 | 10/1966 | Arbonies | 200/277 |
| 5,111,011 | 5/1992 | Roswald | 200/550 |

FOREIGN PATENT DOCUMENTS

| | | | |
|---|---|---|---|
| 2232818 | 12/1990 | United Kingdom | 200/55 |

*Primary Examiner*—Renee S. Luebke
*Attorney, Agent, or Firm*—Leslie A. Rhyne

[57] ABSTRACT

An electrical contact assembly comprises a nonconductive housing (30) having a top portion (32) with at least one aperture (36). A rotatable spherically shaped contact (40) extends partially through the aperture (36). A conductive retainer (50) attached to the housing (30) supports the contact within the housing (30).

7 Claims, 4 Drawing Sheets

ROLLER CONTACT ASSEMBLY

TECHNICAL FIELD

This invention relates generally to electrical contact assemblies and, more particularly, to an electrical contact assembly that rotates as it engages a mating electrical contact.

BACKGROUND

There are a numerous electrical contacts that are commonly used in the art today. An example of such contacts are shown in FIGS. 1-2. FIG. 1 shows a cantilever contact 10 that bends with a spring like action when engaged. The cantilever contact 10 is typically engaged by a mating contact pressing down from a vertical direction, as shown by a direction arrow in FIG. 1, on a top portion of the contact 10 and deflecting the contact 10. After a period of time the cantilever contact 10 looses its spring action and becomes bent in a direction further away from the mating contact and eventually to the point where no connection is made. The cantilever contact 10 cannot engage a mating contact from a horizontal side direction nor from a horizontal front direction because the friction would cause the contact 10 to buckle or the solder joint to become loose from the circuit or break.

FIG. 2 shows a pogo pin contact 20 that engages with a mating connector by a mating connector pressing down in a vertical direction and deflecting the pogo pin 20 as shown by the direction arrow in FIG. 2. The pogo pin contact 20 cannot receive force or a connection from a horizontal direction because it would break the pogo pin contact 20. There is no known contact that can receive a connection from any planar position without causing wither damage or breakage to the contacts.

There is a need in electrical manufacturing and assembly applications for a contact that permits a connection in any planar direction with minimum of friction. For example, in the portable and mobile radio environment a typical user will abuse contacts in a radio housing by constantly pushing and connecting accessories to the radio housing so that a conventional contact will have short life cycle. There are similar problems in other electrical environments, including mobile phones, computers, or any product with printed circuit boards or accessories that need to be electrically connected via electrical contacts. Thus, there is a need to have a reliable contact that permits full planar sliding movement with minimum friction.

SUMMARY OF THE INVENTION

Briefly, according to the invention, there is provided an electrical contact assembly comprising a nonconductive housing having a top portion with at least one aperture and at least one rotatable spherically shaped contact within the housing extending partially through the aperture in the housing. The assembly further includes at least one conductive retainer attachable to the housing for supporting the contact within the housing.

DETAILED DESCRIPTION OF THE PREFERRED EMBODIMENT

Figure 1:
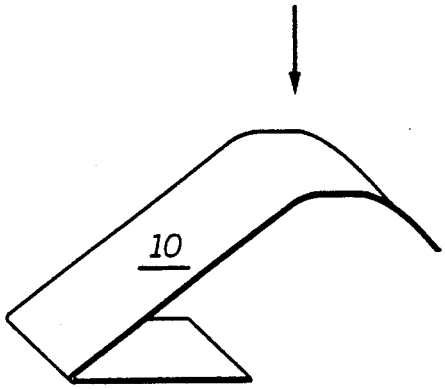
FIG.1 (PRIOR ART)
FIG. 1 is a perspective view of a first prior art contact.
Figure 2:
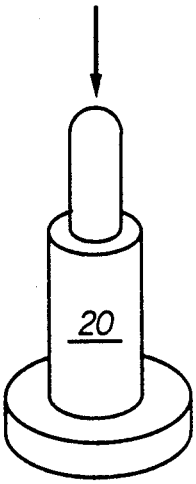
FIG.2 (PRIOR ART)
FIG. 2 is a side view of a second prior art contact.

While the specification concludes with claims defining the features of the invention that are regarded as novel, it is believed that the invention will be better understood from a consideration of the following description in conjunction with the drawing figures, in which like reference numerals are carried forward.

Figure 3:
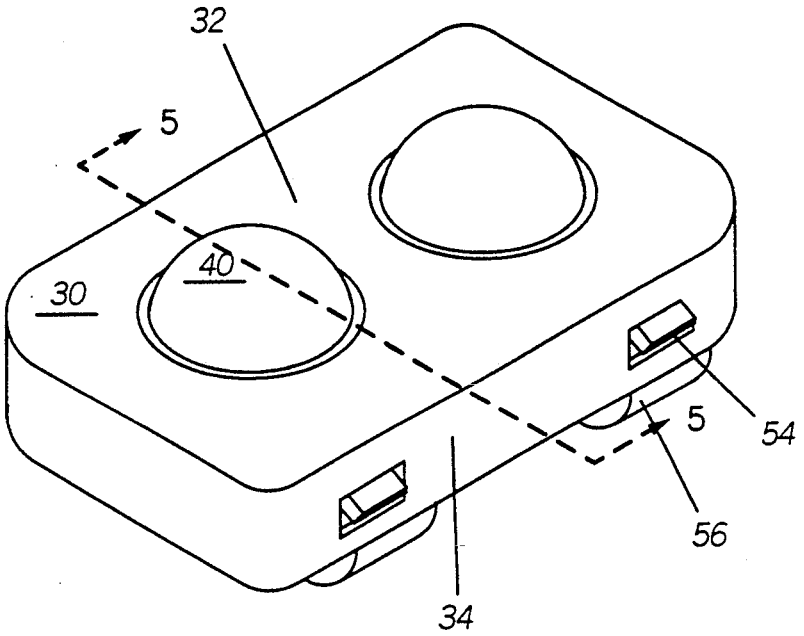
FIG. 3 is a perspective view of a contact assembly according to the present invention.
Figure 4:
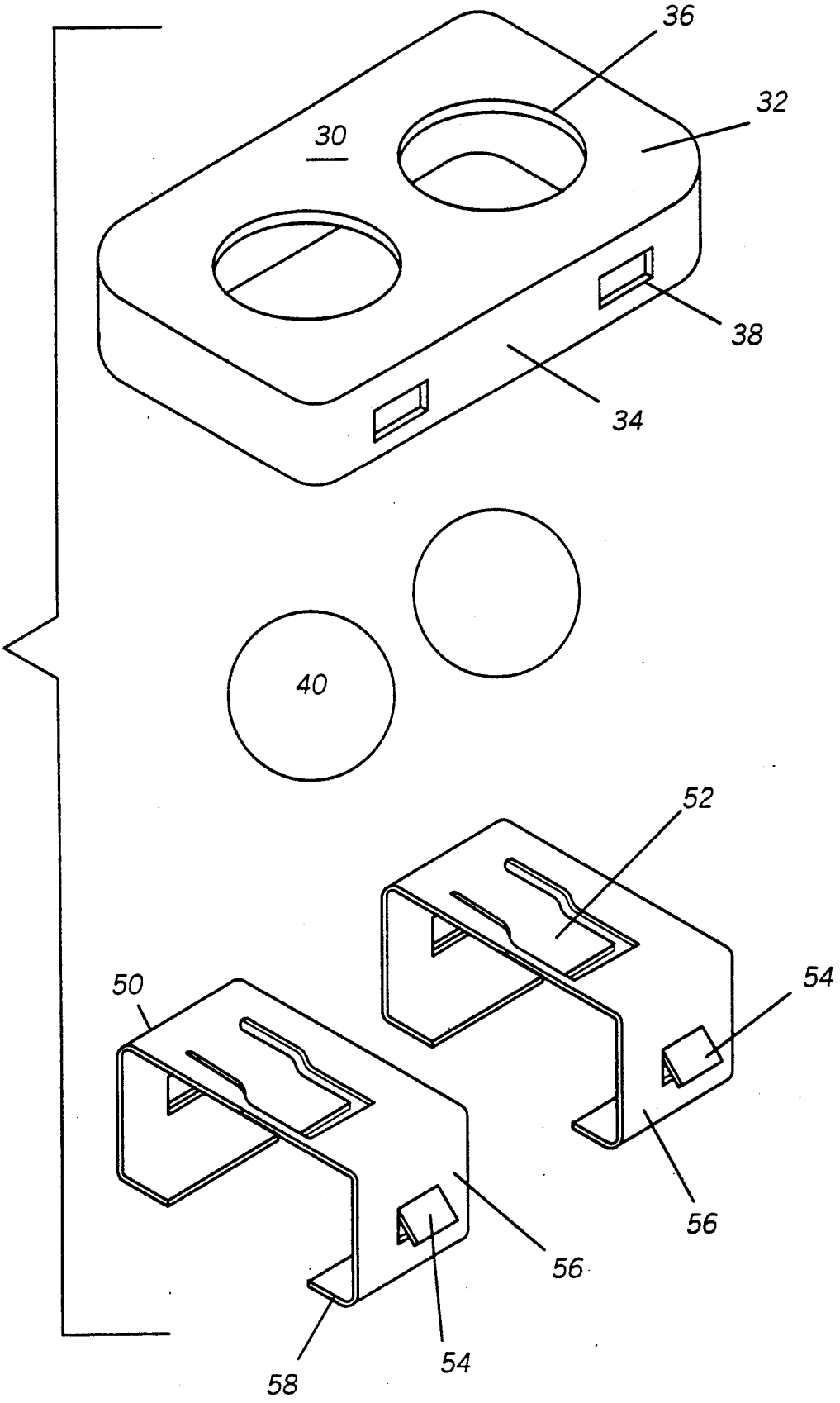
FIG. 4 is an exploded perspective view of a contact assembly according to the present invention.

FIG. 3 shows a roller contact assembly according to the present invention. FIG. 4 shows the roller contact assembly in FIG. 3 in an exploded perspective view. The assembly includes a plastic or nonconductive housing 30 having a top portion 32 and four depending sidewalls. The top portion 32 includes two apertures 36 for receiving two gold plated spherical contacts 40 which extend partially through apertures 36 when the spherical contacts 40 are within the housing 30. Two opposite sidewalls of the housing 30, only one of which are shown 34, include two notches 38 or apertures for engaging retainers 50 within the housing 30. Each retainer 50 includes a cup shaped spring portion 52 which supports one of the spherical contacts 40. The spring portion 52 resilently presses the contact 40 against the top portion 36 of the housing 30 and through the aperture 36. The spring portion 52 presses and holds the contact 40 against the top portion 36 of the housing 30 and the aperture 36 even after a connection is made with a mating contact. The retainer 50 further includes two depending sidewalls 56 which are substantially perpendicular to the spring portion 53. Each sidewall 56 of the retainer 50 includes an extension tab or a spring extension finger 54 for engaging one of the notches 38 of the sidewalls 34 of the housing 30. The spring extension fingers 54 simply snap fit into the corresponding notch 38. Solder tabs 58 or leads extend perpendicular from each sidewall 56 of the retainer 50. The solder tabs 58 are disposed on an opposite side of the retainer 50 from the spring portion 52. The tabs 58 are for connection to any printed circuit board or like circuit. The roller contact assembly can be reflow soldered on a printed circuit board or any like electrical circuit means.

Figure 5:
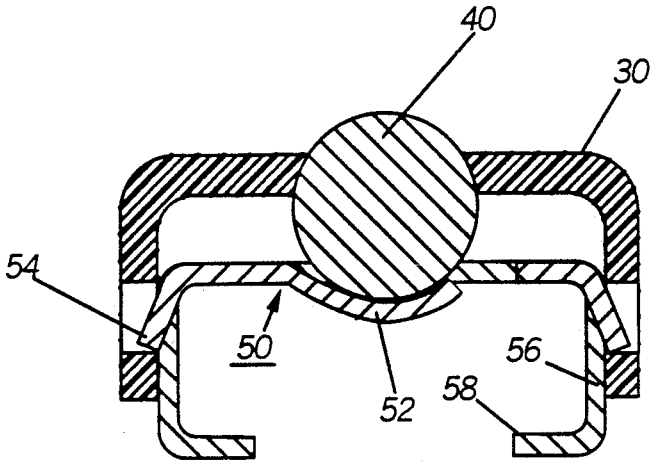
FIG. 5 is a side cross-sectional view taken along line 5—5 of FIG. 3.

FIG. 5 is a side cross-sectional view taken along line 5—5 of FIG. 3. The retainer 50 spring biases the contact 40 against the aperture 36 of the housing 30. The contact 40 is supported by the spring portion 52 but is independent from the spring portion 52 so that it can rotate in all directions on the spring portion 52. Thus, the contact assembly can receive a mating contact from any planar direction with minimum force.

Figure 6:
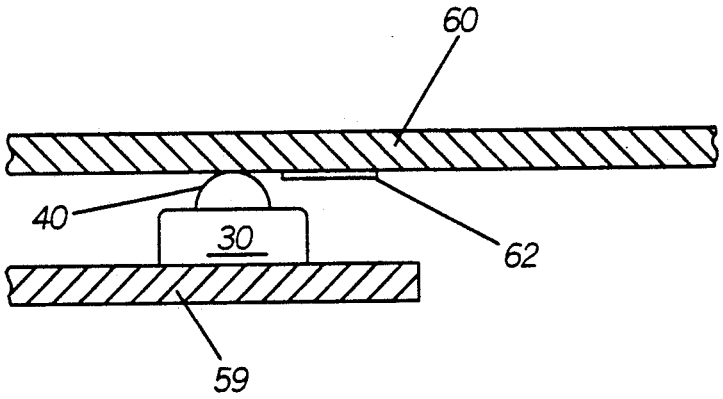
FIG. 6 is a side view of a roller contact assembly and a mating contact.

The contact assembly allows the contacts to receive a mating contact in any planar direction. FIG. 6 shows a roller contact assembly attached to a printed circuit board 59. A mating contact 62 on a second printed circuit board 60 or flex circuit or the like can connect with the roller contact assembly from any planar direction with minimum friction. The spherical contact 40 rotates as it connects to a mating contact. The spherical contact 40 will have a wiping action on the surface of the mating contact 62 surface to clean the surface of any oxidization or residue which may impair the electrical connection. The roller contact assembly may replace conventional switches and be dimensionally smaller than conventional switches.

What is claimed is:

1. An electrical contact assembly comprising:

a nonconductive housing having a top portion with at least one aperture;

at least one rotatable spherically shaped contact within said housing extending partially through said aperture in said housing;

at least one conductive retainer attachable to said housing supporting said contact within said housing; and said housing having at least one depending sidewall with a notch and said retainer having an extension finger that snap fits into said notch.

2. An electrical contact assembly comprising:

a nonconductive housing having a top portion including two apertures and at least two depending sidewalls extending from said top portion, said sidewalls having two notches;

two rotatable spherically shaped contacts within said housing and each said contact extending partially through one of said apertures in said housing;

two conductive retainers wherein each said retainer includes a spring portion resilently biasing one of said contacts partially through said apertures in said housing and two depending sidewalls with each sidewall of each said retainer having an extension finger that snap fits into one of said notches of said sidewalls of said housing.

3. The contact assembly of claim 2 wherein said retainer further comprises at least one solder tab on an opposite side of the retainer from said spring portion.

4. The contact assembly of claim 2 wherein said assembly is surface mountable.

5. An electrical contact assembly comprising:

a nonconductive housing having a top portion including a plurality of apertures and at least two depending sidewalls extending from said top portion, said sidewalls including a plurality of notches;

a plurality of rotatable spherically shaped contacts within said housing and each said contact extending partially through one of said apertures in said housing;

a plurality of conductive retainers wherein each said retainer includes a spring portion resilently biasing one of said contacts partially through said apertures in said housing and each retainer includes two depending sidewalls with each sidewall having an extension finger that snap fits into one of said notches of said sidewalls of said housing.

6. The contact assembly of claim 5 wherein said retainer further comprises a plurality of solder tabs on an opposite side of the retainer from said spring portion.

7. The contact assembly of claim 5 wherein said assembly is surface mountable.

* * * * *